US010520182B2

(12) United States Patent
Suo et al.

(10) Patent No.: US 10,520,182 B2
(45) Date of Patent: Dec. 31, 2019

(54) LAMP AND LIGHTING FIXTURE COMPRISING THE LAMP

(71) Applicant: GE Lighting Solutions, LLC, East Cleveland, OH (US)

(72) Inventors: Yin Suo, Shanghai (CN); Ming Lei, Shanghai (CN); Huisheng Zhou, Shanghai (CN)

(73) Assignee: Consumer Lighting (U.S.), LLC, Norwalk, CT (US)

( * ) Notice: Subject to any disclaimer, the term of this patent is extended or adjusted under 35 U.S.C. 154(b) by 0 days.

(21) Appl. No.: 15/854,894

(22) Filed: Dec. 27, 2017

(65) Prior Publication Data

US 2018/0180275 A1 Jun. 28, 2018

(30) Foreign Application Priority Data

Dec. 27, 2016 (CN) ..... 2016 1 1225008

(51) Int. Cl.
*F21V 29/83* (2015.01)
*F21V 31/00* (2006.01)
(Continued)

(52) U.S. Cl.
CPC ..... *F21V 31/005* (2013.01); *F21K 9/232* (2016.08); *F21K 9/233* (2016.08); *F21K 9/235* (2016.08);
(Continued)

(58) Field of Classification Search
CPC ..... F21V 31/005; F21V 29/83; F21V 3/00; F21K 9/238; F21K 9/232; F21K 9/237; F21K 9/235
See application file for complete search history.

(56) References Cited

U.S. PATENT DOCUMENTS 8,444,299 B2 * 5/2013 Chou ..... F21V 29/004 165/80.3
9,080,757 B2 7/2015 Takahasi et al.
(Continued)

FOREIGN PATENT DOCUMENTS

CN 201589247 U 9/2010
CN 202229088 U 5/2012
(Continued)

*Primary Examiner* — Donald L Raleigh
(74) *Attorney, Agent, or Firm* — Wood IP LLC

(57) ABSTRACT

The present invention discloses a lamp, comprising: an optical cover; a cap for connecting to electrical power; a tubular housing comprising an upper end connected to the optical cover hermetically, a lower end connected to the cap, and at least one vent opening located at a lower portion of the tubular housing; an air flow path inside the tubular housing for communicating an inner surface of the optical cover and the at least one vent opening; and a light source module and a driving module connected to the light source module inside the tubular housing. The present invention also discloses a lighting fixture comprising the above lamp and a lamp holder. The lamp and lighting fixture of the present invention are water resistant. When the gas inside the lamp causes the internal pressure to change due to expanding with heat and contracting with cold, the hermetically connected portions of the lamp are not easy to be damaged.

6 Claims, 6 Drawing Sheets

(51) Int. Cl.

| | |
|---|---|
| ***F21K 9/235*** | (2016.01) |
| ***F21K 9/237*** | (2016.01) |
| ***F21K 9/232*** | (2016.01) |
| ***F21K 9/238*** | (2016.01) |
| ***F21V 23/00*** | (2015.01) |
| ***F21K 9/233*** | (2016.01) |
| *F21V 3/00* | (2015.01) |
| *F21Y 115/10* | (2016.01) |

(52) U.S. Cl.
CPC ..... *F21K 9/237* (2016.08); *F21K 9/238* (2016.08); *F21V 23/006* (2013.01); *F21V 29/83* (2015.01); *F21V 3/00* (2013.01); *F21Y 2115/10* (2016.08)

(56) References Cited

U.S. PATENT DOCUMENTS

| | | | | |
|---|---|---|---|---|
| 9,255,674 | B2 * | 2/2016 | Grajcar | F21V 17/164 |
| 9,335,101 | B2 | 5/2016 | Achammer et al. | |
| 2007/0076413 | A1 | 4/2007 | Mingozzi | |
| 2010/0109499 | A1 * | 5/2010 | Vilgiate | F21V 3/00 313/1 |
| 2010/0164348 | A1 | 7/2010 | Huang et al. | |
| 2010/0264800 | A1 * | 10/2010 | Liu | F21V 29/51 313/46 |
| 2011/0110095 | A1 * | 5/2011 | Li | F21V 29/004 362/294 |
| 2012/0170263 | A1 * | 7/2012 | Rodriguez | F21V 5/007 362/230 |
| 2013/0314928 | A1 | 11/2013 | Bittmann et al. | |
| 2015/0109778 | A1 | 4/2015 | Yokotani et al. | |
| 2015/0109791 | A1 * | 4/2015 | Johnston | G02B 6/0096 362/294 |
| 2016/0327227 | A1 * | 11/2016 | Green, Jr. | F21S 10/043 |

FOREIGN PATENT DOCUMENTS

| | | | |
|---|---|---|---|
| CN | 203395743 | U | 1/2014 |
| CN | 203771087 | U | 8/2014 |
| JP | 2014-154336 | A | 8/2014 |
| WO | 2013/020773 | A2 | 2/2013 |
| WO | 2013/075480 | A1 | 5/2013 |

* cited by examiner

LAMP AND LIGHTING FIXTURE COMPRISING THE LAMP

FIELD

The present invention relates to a field of lighting technology, specifically to a lamp and a lighting fixture comprising the same.

BACKGROUND

Generally, a structure of a lamp comprises an optical cover, a tubular housing, a cap, and a light source module and a driving module mounted inside the tubular housing, in which the optical cover is a transparent or translucent optical element for transmitting light, the cap is used for connecting to electrical power, the light source module comprises LED or other types of light source, and the driving module is used for supplying power to the light source module. Usually, for the purpose of water resistance, the lamp is designed to be totally enclosed, i.e., an upper end of the tubular housing being connected to the optical cover hermetically, a lower end of the tubular housing being connected to the cap hermetically. The heat generated by the light source module and the driving module when in operation will make the gas inside the lamp expand, while the gas inside the lamp will contract when the lamp is turned off or the surrounding temperature decreases. When the gas inside the lamp causes the internal pressure to change due to expanding with heat and contracting with cold, the hermetically connected portions of the lamp are easy to be damaged. Once the hermetically connected portions of the lamp are damaged, the lamp will lose its capability of waterproof, which will cause a severe safety risk.

SUMMARY

In order to solve the above problem, the present invention discloses a lamp and a lighting fixture comprising the lamp, which are water resistant. When the gas inside the lamp causes the internal pressure to change due to expanding with heat and contracting with cold, the hermetically connected portions of the lamp are not easy to be damaged.

In one aspect, the present invention provides a lamp, comprising: an optical cover; a cap for connecting to electrical power; a tubular housing comprising an upper end connected to the optical cover hermetically, a lower end connected to the cap, and at least one vent opening located at a lower portion of the tubular housing; an air flow path inside the tubular housing for communicating an inner surface of the optical cover and the at least one vent opening; and a light source module and a driving module connected to the light source module inside the tubular housing.

In another aspect, the present invention provides a lighting fixture, comprising the lamp as mentioned above and a lamp holder. The lamp holder is connected to an outer surface of the tubular housing of the lamp hermetically, and forms a third space between the outer surface of the tubular housing and an inner surface of the lamp holder. The at least one vent opening as mentioned above allows air flow between the air flow path inside the tubular housing and the third space.

The technical solution of the present invention makes a design on the structures of the lamp and the lighting fixture, in which an air flow path is arranged inside the tubular housing of the lamp so that air flow is allowed in a space inside the lamp, and a vent opening is set up on the tubular housing to make the space inside the lamp in communication with the external of the tubular housing. When the lamp is mounted on the lamp holder, the outer surface of the tubular housing of the lamp is connected to the lamp holder hermetically, forming a third space between the outer surface of the tubular housing and the inner surface of the lamp holder, allowing air flow between the space inside the lamp and the third space. By such a design, when the gas inside the lamp causes the internal pressure to change due to expanding with heat and contracting with cold, the hermetically connected portions of the lamp are not easy to be damaged.

DETAILED DESCRIPTION

Further detailed explanations will be made in the following by combining with the figures and the detailed embodiments. Unless defined otherwise, the technical or scientific terms used herein should be the meanings as commonly understood by one of ordinary skilled in the art to which the present disclosure belongs. The terms "first", "second" and the similar ones used herein do not mean any sequential order, quantity or importance, but are only used for distinguishing different parts or elements. The terms "a", "an" and the like used herein do not denote a limitation of quantity, but denote the existence of at least one. The term "or" does not mean exclusion, but means there is at least one of the mentioned items (such as composition), including situations that there may be combinations of the mentioned items. The terms "comprising", "including", "having" or "containing" and the like mean that, in addition to the items listed thereafter and equivalents thereof, other items may also be encompassed therein.

Figure 1:
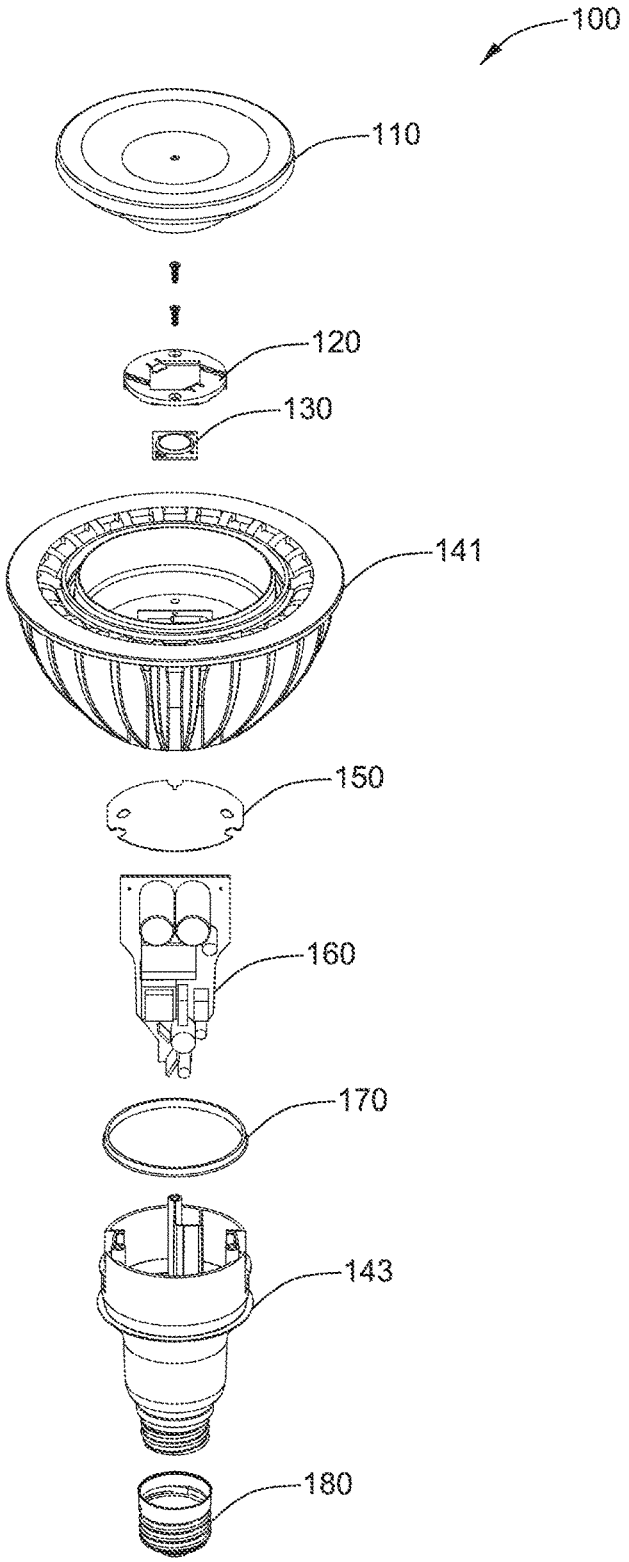
FIG. 1 is an exploded view of a lamp according to a first embodiment of the present invention.
Figure 2:
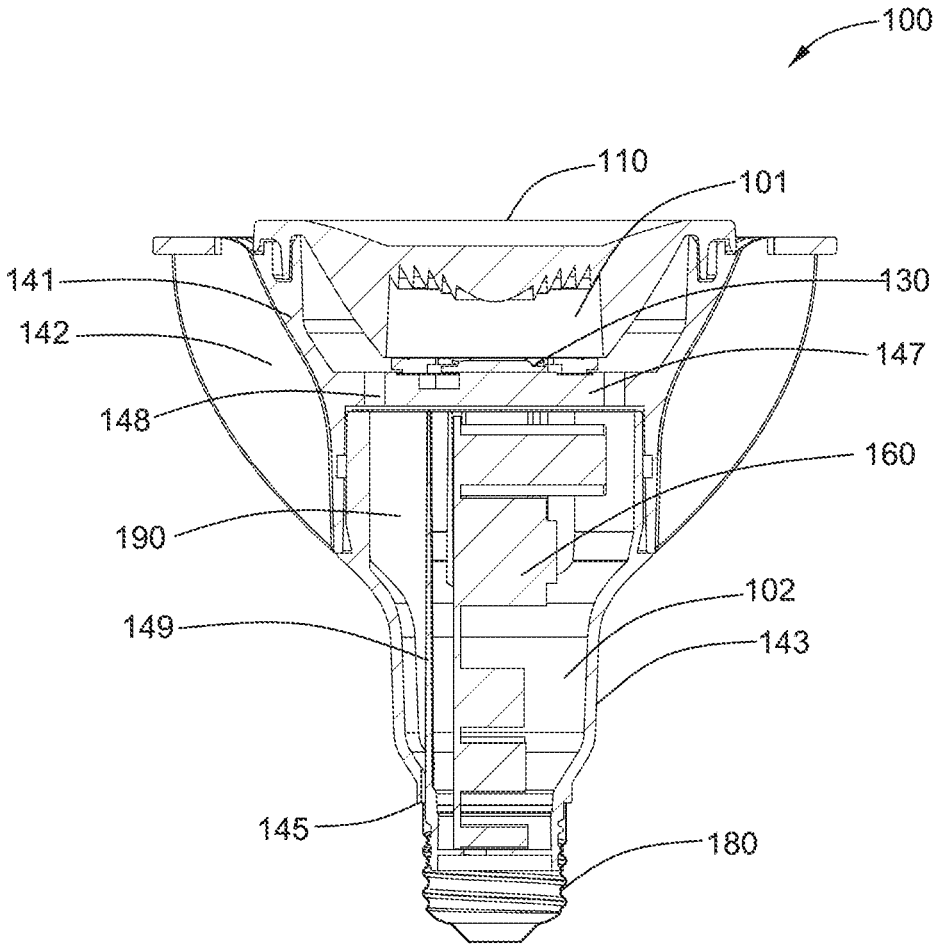
FIG. 2 is a sectional view of a whole structure of the lamp according to the first embodiment of the present invention.
Figure 3:
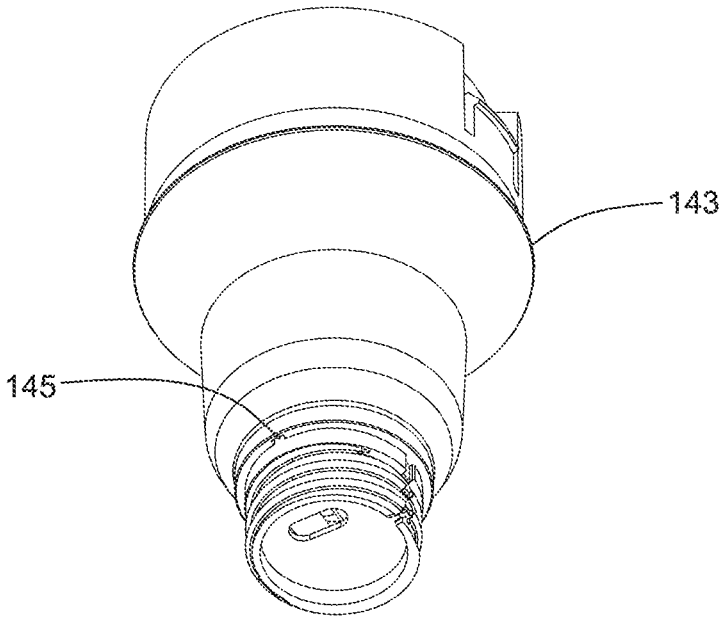
FIG. 3 and FIG. 4 are three-dimensional views of a lower tube of the lamp according to the first embodiment of the present invention.

FIG. 1 and FIG. 2 illustrate a lamp 100 of the first embodiment of the present invention. The lamp 100 comprises an optical cover 110, a cap 180, a tubular housing consisting of an upper tube 141 and a lower tube 143, an air flow path 190 inside the tubular housing, and a light source module 130 and a driving module 160 electrically connected to the light source module 130 inside the tubular housing. The tubular housing, specifically an upper end of the upper tube 141 is connected with the optical cover 110 hermetically, and the tubular housing, specifically a lower end of the lower tube 143 is connected with the cap 180. The connection with the cap may be a hermetical connection, and may also be a non-hermetical connection. The cap 180 is connected to the electrical power. The lower tube 143 also comprises at least one vent opening 145 located at a lower portion thereof. Inside the tubular housing consisting of the upper tube 141 and the lower tube 143, the air flow path 190 communicates an inner surface of the optical cover 110 and the at least one vent opening 145. Moreover, it needs to be noted that the "hermetical connection" mentioned herein refers to a gas-tight or a liquid-tight connection, specifically refers to waterproof at the connected portions.

The upper tube 141 can be made of a second thermally conductive material, for example, a metal material with a good heat dispersion, and the lower tube 143 can be made of an insulating material, for example, plastic. The two, the upper tube 141 and the lower tube 143, may be connected hermetically by a sealing ring 170 to constitute the tubular housing. Inside the tubular housing, the light source module 130 is mounted on a side near the optical cover 110, while the driving module 160 electrically connected with the light source module 130 is mounted on a side near the cap 180.

Furthermore, the lamp 100 may also comprise a partition plate 147 located inside the tubular housing. The partition plate 147 and the upper tube 141 are formed integrally. Inside the tubular housing, a first space 101 is formed between the partition plate 147 and the optical cover 110 for receiving the light source module 130 that is fixed on a face of the partition plate 147 towards the optical cover 110 by a light source module fixing member 120; a second space 102 is formed between the partition plate 147 and the cap 180 for receiving the driving module 160. In addition, a plane in which the partition plate 147 resides is substantially perpendicular to an axial direction of the upper tube 141, and there is at least one through hole 148 (shown as two in the figure) on the partition plate 147 for allowing wires passing through and air flow. Inside the tubular housing, the gas can flow between the first space 101 and the second space 102 through the through the hole 148, forming a part of the air flow path 190.

Figure 4:
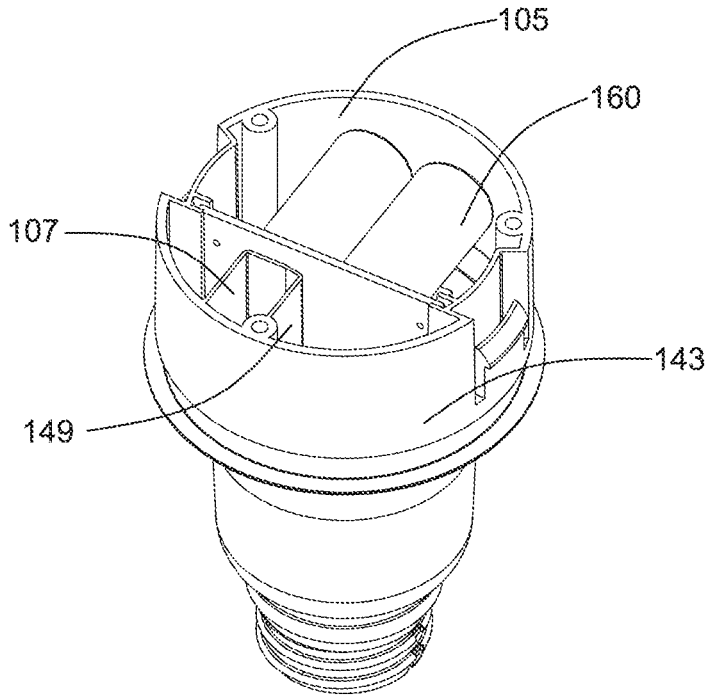

Furthermore, the lamp 100 may also comprise a separation wall 149 located in the second space 102, as shown in FIG. 4. The cross section of the separation wall 149 is for example U-shaped, which separates the second space 102 into a driving chamber 105 for receiving the driving module 160 and a channel 107. The channel 107 is bounded by the separation wall 149 and a part of the lower tube 143, for connecting the at least one through hole 148 on the partition plate 147 and the at least one vent opening 145 at the lower portion of the lower tube 143, forming a part of the air flow path 190. The separation wall 149 may serve as an independent member which is mounted in the second space 102, or may also be formed integrally together with the lower tube 143 during processing the lower tube 143.

Furthermore, the driving chamber 105 is filled with a first thermally conductive material. The driving module 160 mounted in the driving chamber 105 will generate heat when in operation. In order to enhance heat dispersion effect, in the driving chamber 105, the surrounding gap of the driving module 160 is filled with the first thermally conductive material, and such process is called "gluing". Generally, the first thermally conductive material may comprise epoxy resin, silicon-based compound or other thermally conductive material and combinations of multiple types of thermally conductive material. Specifically, usually the driving module 160 is mounted in the driving chamber 105 at first, then the first thermally conductive material in a state of flow is injected into the surrounding gap of the driving module 160 in the driving chamber 105. The first thermally conductive material would be solidified due to occurrence of polycondensation reaction, addition reaction or other chemical reaction, thus condensing around the driving module 160.

Furthermore, in order to increase heat dispersion performance, the upper tube 141 may also comprise a number of heat sinks 145 protruding outward from an outer surface of the upper tube 141, as shown in FIG. 1. There are intervals arranged between the heat sinks 145, thus benefiting air circulation and heat dispersion. The upper tube 141 having a function of heat dispersion may also be called "radiator".

In addition, as shown in FIG. 1, the lamp 100 may also comprise an insulation plate 150 which is mounted between the partition plate 147 and the driving module 160. The insulation plate 150 is also provided with at least one through hole 151 thereon, for example, three through holes as shown in the figure, which are consistent with the three through holes 148 on the partition plate 147 in positions, so as to ensure air flow between the first space 101 and the second space 102.

Figure 5:
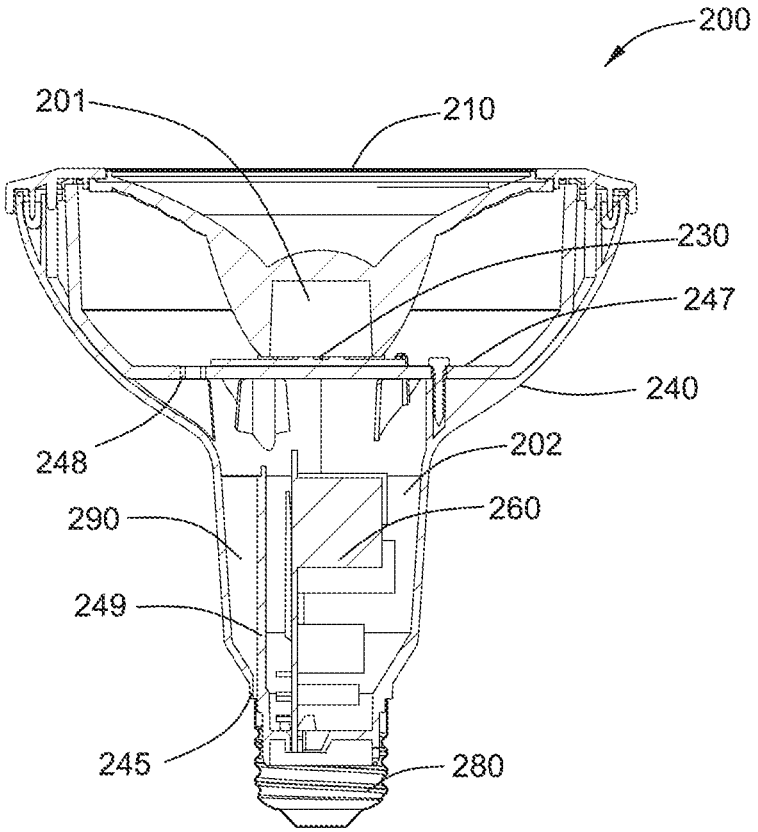
FIG. 5 is a sectional view of a whole structure of a lamp according to a second embodiment of the present invention.

FIG. 5 illustrates a lamp 200 of a second embodiment of the present invention. The lamp 200 comprises an optical cover 210, a cap 280, a tubular housing 240, an air flow path 290 located inside the tubular housing 240, and a light source module 230 and a driving module 260 located inside the tubular housing 240. Similar to the lamp 100 in the first embodiment, an upper end of the tubular housing 240 is connected with the optical cover 210 hermetically, and a lower end of the tubular housing 240 is connected with the cap 280 hermetically or non-hermetically. The tubular housing 240 also has at least one vent opening 245 at a lower portion thereof. The main difference between the lamp 200 and the lamp 100 in the first embodiment lies in that the tubular housing 240 of the lamp 200 is an integral structure, while the tubular housing in the lamp 100 is formed by hermetically connecting the upper tube 141 and the lower tube 143 made of different material via the sealing ring.

In addition, similarly, the lamp 200 may also comprise a partition plate 247 located inside the tubular housing 240, but in the present embodiment, the partition plate 247 is a box with a flat bottom face and an opening upward. There is at least one through hole 248 on the flat bottom face, and the plane on which the flat bottom face resides is substantially perpendicular to an axial direction of the tubular housing 240. The partition plate 247 is connected with an inner surface of the tubular housing 240. A first space 201 is formed between the optical cover 210 and the partition plate 147 for receiving the light source module 230 that is fixed on a face of the partition plate 247 towards the optical cover 210. A second space 202 is formed between the partition plate 247 and the cap 280 for receiving the driving module 260. The first space 201 and the second space 202 communicate with each other via the at least one through hole 248, forming a part of the air flow path 290.

Furthermore, the lamp 200 also comprises a separation wall 249 located in the second space 202. The separation wall 249 separates the second space 202 into a driving chamber 205 for receiving the driving module 260 and a channel 207. The channel 207 is bounded by the separation wall 249 and a part of the tubular housing 240, for connecting the at least one through hole 248 and the at least one vent opening 245, forming a part of the air flow path 290. The separation wall 249 may serve as an independent member which is mounted in the second space 202, or may also be formed integrally together with the tubular housing 240 during processing the tubular housing 240.

Preferably, in order to enhance heat dispersion effect, the driving chamber 205 is filled with a first thermally conductive material. As to the first thermally conductive material and the filling process, they are substantially the same as those in the first embodiment.

Figure 6:
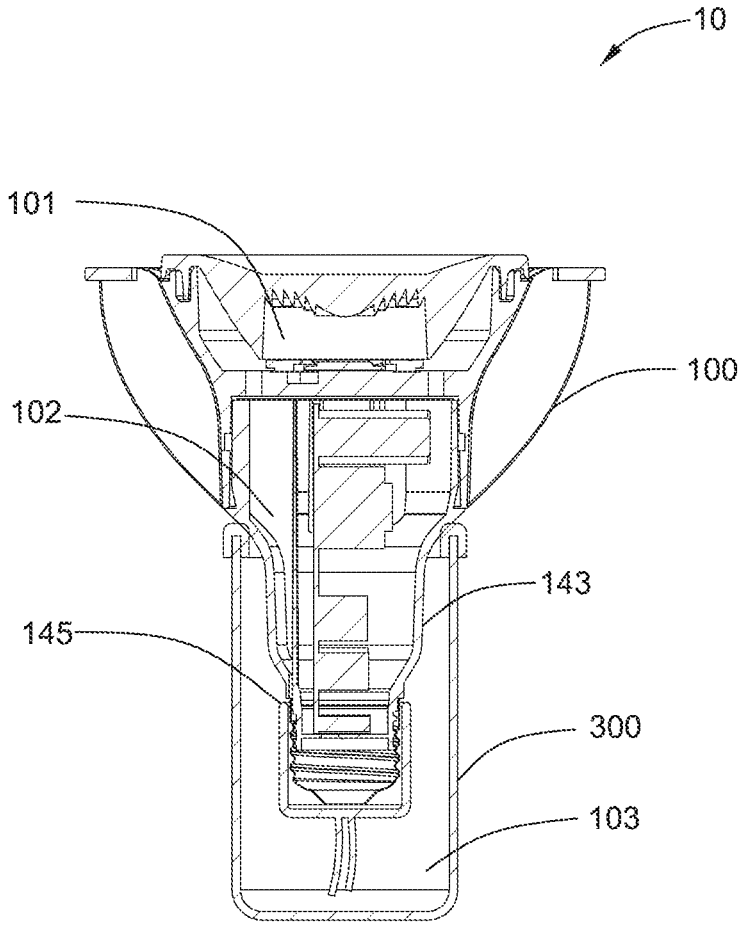
FIG. 6 is a sectional view of a whole structure of a lighting fixture according to an embodiment of the present invention.

The embodiments of the present invention also relate to a lighting fixture, and FIG. 6 illustrates a sectional view of a structure of a lighting fixture 10 according to an embodiment of the present invention. As shown in FIG. 6, the lighting fixture 10 comprises the lamp 100 of the first embodiment of the present invention and a lamp holder 300. The lamp holder 300 is a box with an opening. The edge of the opening is connected to an outer surface of the lower tube 143 constituting the tubular housing of the lamp 100 hermetically, forming a third space 103 between the outer surface of the lower tube 143 and an inner surface of the lamp holder 300. The vent opening 145 allows air flow between the path 190 inside the lamp 100 and the third space 103. In this way, in the whole lighting fixture 10, the first space 101, the second space 102 and the third space 103 communicate with each other. When the gas inside the lamp causes the internal pressure to change due to expanding with heat and contracting with cold, the hermetically connected portions of the lamp are not easy to be damaged. The lighting fixture involved in the embodiments of the present invention may also comprise the lamp 200 of the second embodiment.

Although the present invention has been set forth in combination with specific embodiments, the person skilled in the art shall understand that many modifications and variations may be made to the present invention. Therefore, it should be recognized that the intention of the claims is to cover all these modifications and variations within the real concept and range of the present disclosure.

What is claimed is:

1. A lamp, comprising:

an optical cover;

a cap for connecting to electrical power;

a housing comprising an upper end connected to the optical cover hermetically, a lower end connected to the cap, and at least one vent opening located at a lower portion of the housing;

an air flow path inside the housing for communicating an inner surface of the optical cover and the at least one vent opening;

a light source module inside the housing; and a driving module electrically connected to the light source module inside the housing;

the lamp further comprising:

a partition plate inside the housing for receiving the light source module that is fixed on a face of the partition plate towards the optical cover, and wherein inside the housing, a first space is formed between the optical cover and the partition plate for receiving the light source module, and a second space is formed between the partition plate and the cap for receiving the driving module, the partition plate comprising at least one through hole with wire passing through and for allowing air flow between the first space and the second space thereby forming the air flow path, wherein the second space is separated by a separation wall into a driving chamber for receiving the driving module and a channel for connecting the at least one through hole and the at least one vent opening.

2. The lamp of claim 1, wherein the separation wall and the housing are formed integrally.

3. The lamp of claim 1, wherein the driving chamber is filled with a flowable thermally conductive material.

4. The lamp of claim 1, wherein the light source module is fixed on the partition plate, and a plane of the partition plate is substantially perpendicular to an axial direction of the housing.

5. The lamp of claim 1, wherein the housing comprises an upper portion made of a metallic material and the lower portion made of an insulating material, the upper portion and the lower portion being connected hermetically by a sealing ring.

6. A lighting fixture, comprising:

a lamp, comprising:

an optical cover;

a cap for connecting to electrical power;

a tubular housing comprising an upper end connected to the optical cover hermetically, a lower end connected to the cap, and at least one vent opening located at a lower portion of the tubular housing;

an air flow path inside the tubular housing for communicating an inner surface of the optical cover and the at least one vent opening;

a light source module inside the tubular housing; and a driving module connected to the light source module inside the tubular housing; and a lamp holder, connected to an outer surface of the tubular housing of the lamp hermetically, forming a third space between the tubular housing and the lamp holder, the at least one vent opening allowing air flow between the air flow path and the third space.

* * * * *